US005247315A

United States Patent [19]

Phelan et al.

[11] Patent Number: 5,247,315

[45] Date of Patent: Sep. 21, 1993

[54] METHOD OF PRINTING A GRAPHIC HAVING UNIFORM INK DENSITY ON AN EMULSION COATED PRINTING SCREEN

[75] Inventors: Brian D. Phelan, Cheshire; Mark E. Guckin, Middletown; David A. Daraskevich, East Hartford; Jules P. Prockter, Vernon; Russell F. Croft, Tolland, all of Conn.

[73] Assignee: Gerber Scientific Products, Inc., Manchester, Conn.

[21] Appl. No.: 831,908

[22] Filed: Feb. 6, 1992

[51] Int. Cl.[5] ..... B41J 2/01

[52] U.S. Cl. ..... 346/140 R

[58] Field of Search ..... 346/1.1, 140 R

[56] References Cited

U.S. PATENT DOCUMENTS

| | | | |
|---|---|---|---|
| 3,689,932 | 9/1972 | Gerber | 346/29 |
| 4,272,771 | 6/1981 | Furukawa | 346/75 |
| 4,622,561 | 11/1986 | Koike | 346/1.1 |
| 4,748,453 | 5/1988 | Lin et al. | 346/1.1 |
| 4,855,752 | 8/1989 | Bergstedt | 346/1.1 |
| 4,920,355 | 4/1990 | Katerberg | 346/1.1 |
| 4,943,813 | 7/1990 | Palmer et al. | 346/1.1 |
| 4,963,882 | 10/1990 | Hickman | 346/1.1 |
| 4,965,593 | 10/1990 | Hickman | 346/140 R |
| 4,967,203 | 10/1990 | Doan et al. | 346/1.1 |
| 4,999,646 | 3/1991 | Trask | 346/1.1 |
| 5,059,984 | 10/1991 | Moore et al. | 346/1.1 |
| 5,070,345 | 12/1991 | Lahut et al. | 346/1.1 |

*Primary Examiner*—Mark J. Reinhart
*Assistant Examiner*—N. Le
*Attorney, Agent, or Firm*—McCormick, Paulding & Huber

[57] ABSTRACT

A method for printing a graphic having uniform ink density on selected pixel locations of a printing screen coated with a light sensitive emulsion is provided. According to one embodiment of the invention, only some of the pixel locations are printed as required to form a desired image during the first pass of a printhead across a strip of the emulsion coated screen. The remaining pixel locations are printed as required during a second pass of the printhead across the strip. According to a second embodiment of the invention, a portion of the pixel locations in each strip are re-printed on the next succeeding pass of the printhead across the screen.

2 Claims, 4 Drawing Sheets

METHOD OF PRINTING A GRAPHIC HAVING UNIFORM INK DENSITY ON AN EMULSION COATED PRINTING SCREEN

BACKGROUND OF THE INVENTION

The present invention relates generally to the field of screen printing. More particularly, the invention provides a method for printing a graphic having uniform ink density on a printing screen coated with a light-sensitive emulsion.

Pending U.S. patent application Ser. No. 628,620, assigned to the present assignee, discloses a method and apparatus for printing a graphic on a light-sensitive emulsion which has previously been applied to one surface of a printing screen. As disclosed therein, an ink-jet or thermal printer may be used to print the graphic either directly on the emulsion or on an ink receptive coating applied to the emulsion. It has been found that in some instances the ink density of the graphic is non-uniform. This is particularly the case where the graphic includes extensive areas of solid ink.

The problem results from the fact that the surface tension of the ink prevents it from being immediately and uniformly absorbed into the emulsion as the ink is applied. Instead, the ink tends to be drawn to the center of the printed area. This effect is illustrated in FIGS. 1(*a*) and 1(*b*). FIG. 1(*a*) shows an area of solid print 10 immediately after it has been applied to a light-sensitive emulsion 12 by, for example, the single pass of an ink-jet printhead across the emulsion. FIG. 1(*b*) shows the same printed area a short time after the ink has been applied. As illustrated in FIG. 1(*b*), the ink migrates to the center of the printed area to form a band 14 of relatively high ink density and two bands 16, 18 of relatively low ink density.

As illustrated in FIG. 2, the ink from the next pass of the printhead across the emulsion produces the same effect. Thus, as successive lines of print 20, 22, 24 are applied to the emulsion 12, areas 26, 28, 30 of high ink density alternate with areas 32, 34, 36, 38 of relatively low ink density. These areas or bands of low ink density are referred to as scan lines, and the low ink density of the scan lines is insufficient to block UV light when the light-sensitive emulsion is exposed. Thus, after the emulsion is washed out, a scan line of unexposed emulsion is left embedded in the finished screen, rendering the screen unsuitable for printing purposes.

Accordingly, it is an object of the present invention to provide a method for printing a graphic on an emulsion coated printing screen wherein the problem of scan lines is eliminated.

SUMMARY OF THE INVENTION

The present invention meets these and other objects by providing a method for printing a graphic having uniform ink density on selected pixel locations of a light sensitive emulsion, after the emulsion has been applied to one surface of a printing screen. According to one embodiment of the invention, a printing screen having a light-sensitive emulsion applied to one surface thereof is mounted in a printing device which includes a printhead having a plurality of ink-ejecting elements. The screen is mounted in the device so that the emulsion-coated surface of the screen faces the ink-ejecting elements.

Once the screen has been properly mounted in the device, the printhead is directed, typically under computer control, to make a first pass across a first strip of the emulsion. The strip includes an upper and lower portion, and the pixel locations in the lower portion of the strip are printed as required to produce a desired image. The printhead then makes a second pass across a second strip of the emulsion. The second strip also has an upper portion which overlaps the lower portion of the first strip and further includes a lower portion. As the printhead passes over the second strip the pixel locations in the lower portion of the first strip printed in the first pass are re-printed and the pixel locations in the lower portion of the second strip are printed as required to produce a desired image. The printhead then makes a third pass across a third strip of the emulsion. Again, the third strip has an upper portion which overlaps the lower portion of the second strip and further includes a lower portion. The pixel locations in the lower portion of the second strip printed in the second pass are reprinted as the printhead makes its third pass across the emulsion, and the pixel locations in the lower portion of the third strip are printed as required to produce a desired image. The printhead is caused to continuously pass across a plurality of succeeding strips of the emulsion, and the requirements of the first, second and third passes are repeated until the entire graphic is printed.

In a second embodiment of the invention, the emulsion-coated screen is mounted as before, and, prior to the printing operation, the emulsion is provided with an ink-receptive material. The printhead is then directed to make a first pass across a first strip of the emulsion, wherein only some of the pixel locations in the strip are printed as required to produce a desired image. The printhead then makes a second pass across the first strip of the emulsion to print the remaining pixel locations in the strip as required to produce a desired image. The printhead is directed to make continuous passes across a plurality of succeeding strips of the emulsion, and the requirements of the first and second passes are repeated for each of the strips until the entire graphic is printed.

BRIEF DESCRIPTION OF THE DRAWINGS

FIG. 1(*b*) is a schematic illustration of the strip shown in FIG. 1(*a*) after the ink has migrated toward the center of the strip.

DETAILED DESCRIPTION OF THE INVENTION

Figure 3:
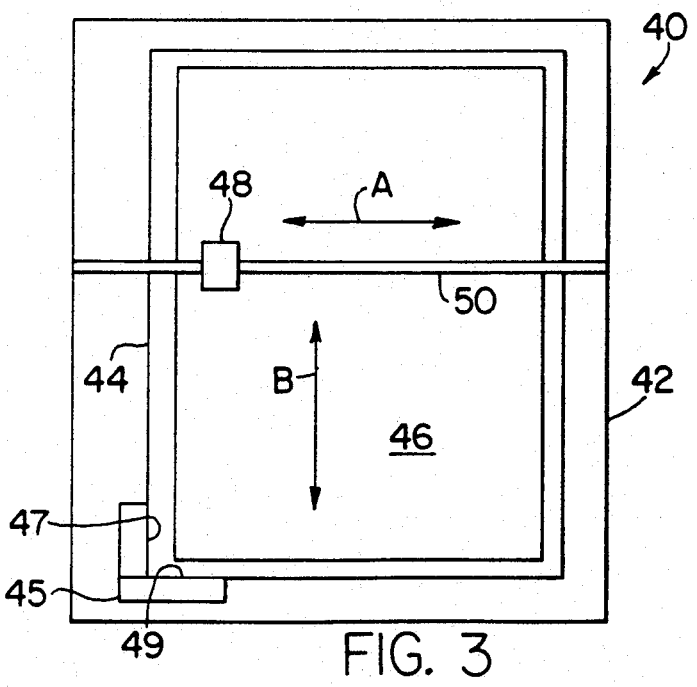
FIG. 3 is a schematic illustration of a printing device useful for printing emulsion-coated printing screens.

A printing device suitable for printing a graphic on an emulsion-coated screen according to the present method is illustrated in FIG. 3. Such a device is disclosed in the above-referenced co-pending application; however, it is to be understood that other printing devices may be utilized. The device 40 includes a support surface 42 for supporting a printing screen 44 having a light-sensitive emulsion 46 applied thereto. The device also includes a printhead 48 slidable on a support carriage 50 for movement back an forth across screen 44 in the along the printing axis indicated by arrow A. The printhead comprises a number of ink-ejecting nozzles (not shown) which are individually directed to eject or withhold ink to print a desired image as the printhead 48 moves across the emulsion 46. The device 40 also includes conventional means (not shown) for advancing the screen 44 relative to the printhead 48 along the printing axis indicated by arrow B to print successive lines of print on the emulsion. Ink ejection and the movement of the screen relative to the printhead are controlled by conventional computer means (not shown).

The device 40 further includes a guide 45 mounted on support surface 42. The guide includes a guide surface 47 disposed along the printing axis indicated by arrow A and a guide surface 49 disposed along the printing axis indicated by arrow B. The guide surfaces 47, 49 are movable with respect to one another which permits a selected location on the screen to be aligned with the home position of the printhead, that is, the location of the printhead at the beginning of the printing operation. By properly aligning the screen with respect to the printhead and providing the computer control means with data defining the graphic to be printed, the dimensions of the screen and selected coordinates within the dimension of the screen with which corresponding references coordinates of the graphic are to register when the graphic is printed on the emulsion, proper positioning of the graphic on the screen is insured.

Figure 4:
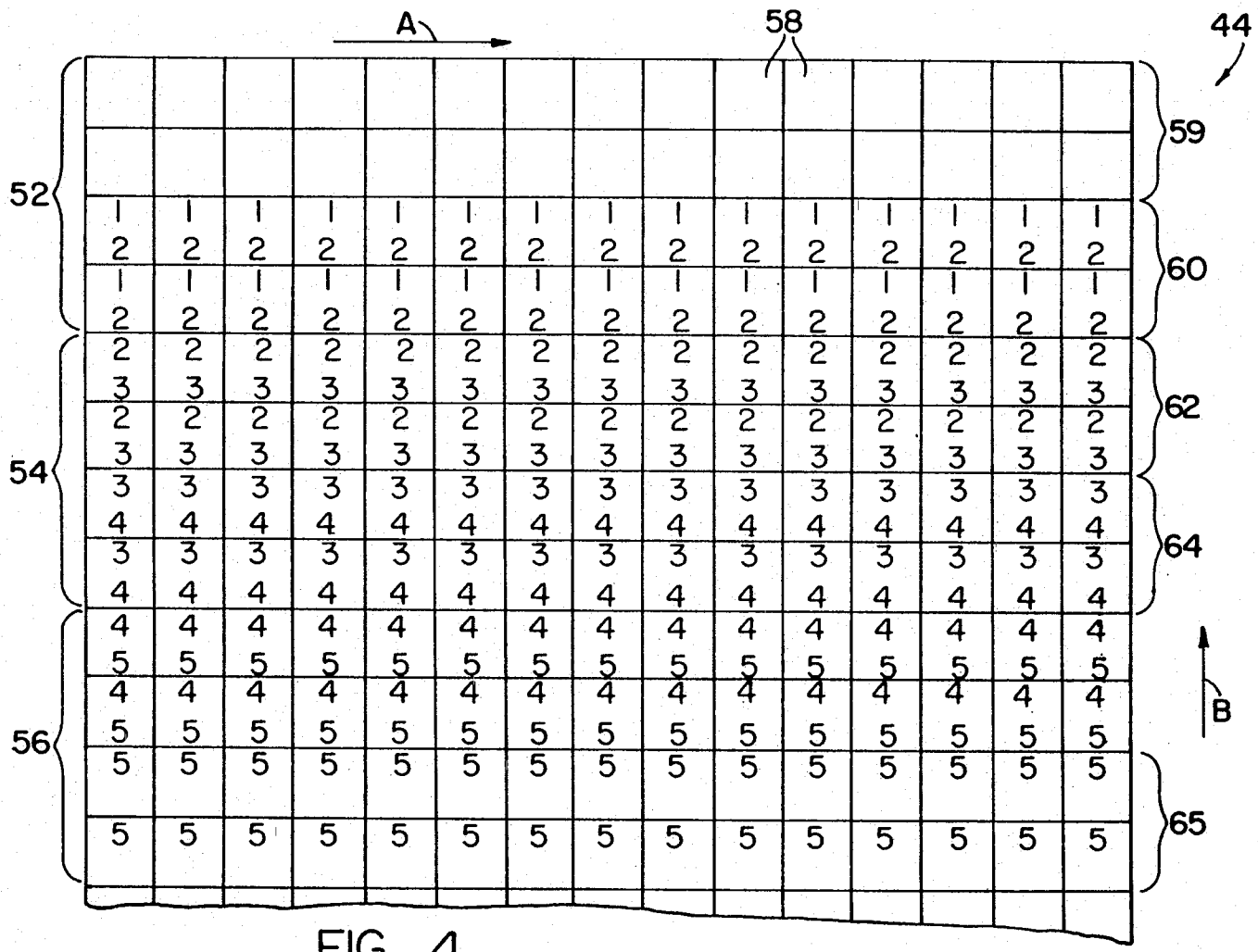

Referring now to FIG. 4, a section of the emulsion-coated screen is shown. The illustrated section of the screen includes three lines or strips of print 52, 54, 56 divided into a plurality of pixel locations 58, 58. The strip 52 includes an upper portion 59 and a lower portion 60, and, as the printhead moves across strip 52 in the direction indicated by arrow A, ink-ejection is controlled so that selected pixel locations in the lower portion 60 of strip 52 are printed to form a desired image. The pixel locations printed during the first pass of the printhead are designated 1, 1. Once strip 52 has been printed, it would be the normal practice to advance the screen relative to the printhead in the direction indicated by arrow B so that the printhead would be in position to move across and print strip 54 of the emulsion-coated screen. However, according to the present invention, the printhead and screen are moved relative to one another so that the previously printed pixel locations in a lower portion 60 of strip 52 are re-printed, and the pixel locations in an upper portion 62 of strip 54 are printed as required for the first time to form a desired image. The pixel locations on the screen printed during the second pass of the printhead are designated 2, 2.

After the second pass of the printhead is complete, the screen and printhead are moved relative to one another so that during the printhead's third pass across the screen, the previously printed pixel locations in the upper portion 62 of strip 54 are re-printed and selected pixel locations in the lower portion 64 of strip 54 are printed as required for the first time to form a desired image. The pixel locations printed during the third pass of the printhead across the screen are designated 3, 3.

The printhead is directed to make continuous passes, such as illustrated passes four and five, across succeeding strips of the emulsion, in the manner described above with regard to the first, second and third passes, until the entire graphic is printed. It has been discovered that when the emulsion-coated screen is printed in this manner, scan lines can be completely eliminated and a sharp, clear graphic having uniform ink density is achieved.

Figure 5:
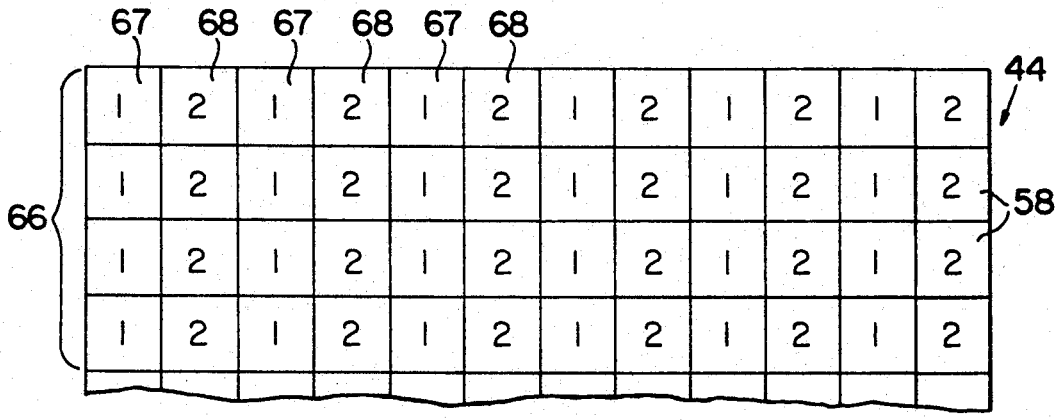

Referring now to FIG. 5, a second preferred embodiment of the invention will be described. According to this embodiment, the emulsion is provided with an ink-receptive material prior to printing selected pixel locations to form the graphic. This may be accomplished by applying and ink receptive coating to the emulsion prior to the printing operation or by incorporating the ink receptive material in the emulsion layer or the printing ink or both. Suitable coating materials are finely divided powders such as, for example, talc. Other ink-receptive materials are surfactants, wetting agents or adsorbents which may be used alone or in combination and are well-known to those skilled in the art.

As the printhead moves across a strip of the screen only some of those pixel locations are printed as required to form a desired image. For example, FIG. 5 illustrates a strip 66 of the emulsion-coated screen 44 wherein the pixel locations 58, 58 are arranged in odd 67, 67 and even 68, 68 numbered columns. The printhead moves across the strip 66 twice. During the first pass only those pixel locations in the odd numbered columns are printed as required to form a desired image. The pixel locations in the even numbered columns are printed as required to form a desired image during the second pass of the printhead across the strip. The pixel locations printed during the first and second passes of the printhead are designated 1, 1 and 2, 2 respectively. After the second pass of the printhead is complete, the screen and the printhead are moved relative to one another so that the above-described printing procedure can be performed on the next succeeding strip of the screen. The printhead is directed to make continuous passes across succeeding strips of the screen until the entire graphic is completed.

Figure 6:
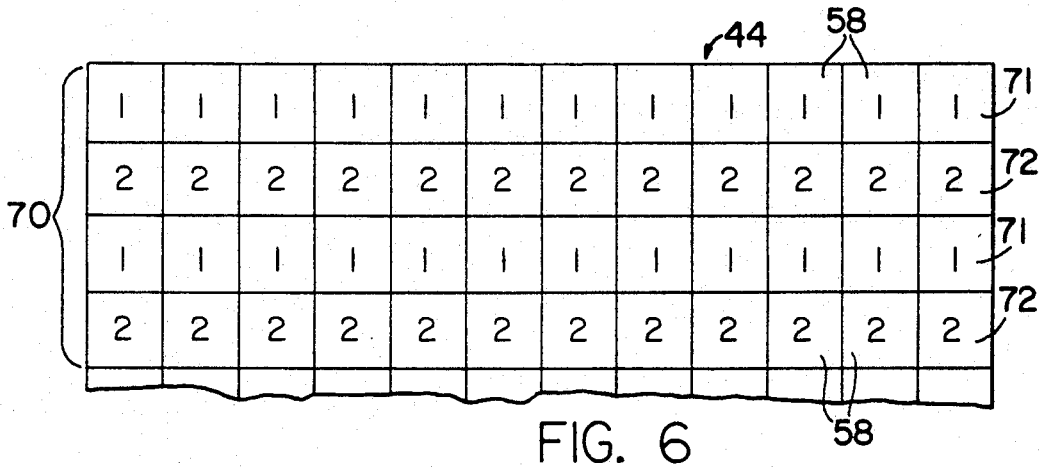

The printing pattern utilized in this particular embodiment of the invention can be modified in any number of ways. For example, FIG. 6 illustrates a strip 70 of the emulsion-coated screen 44 wherein the pixel locations 58, 58 are arranged into odd 71, 71 and even 72, 72 numbered rows. Again, two passes of the printhead across the strip are required to print all of the pixel locations in the strip that must be printed to form a desired image. During the first pass only those pixel locations in the odd numbered rows are printed as required to form a desired image, and during the second pass, the pixel locations in the even numbered rows are printed as required. The pixel locations printed during the first and second passes of the printhead are designated 1, 1 and 2, 2 respectively. After the second pass of the printhead is complete, the screen and the printhead are moved relative to one another so that the above-described printing procedure can be performed on the next succeeding strip of the screen. The printhead is directed to make continuous passes across succeeding strips of the screen until the entire graphic is completed.

Figure 7:
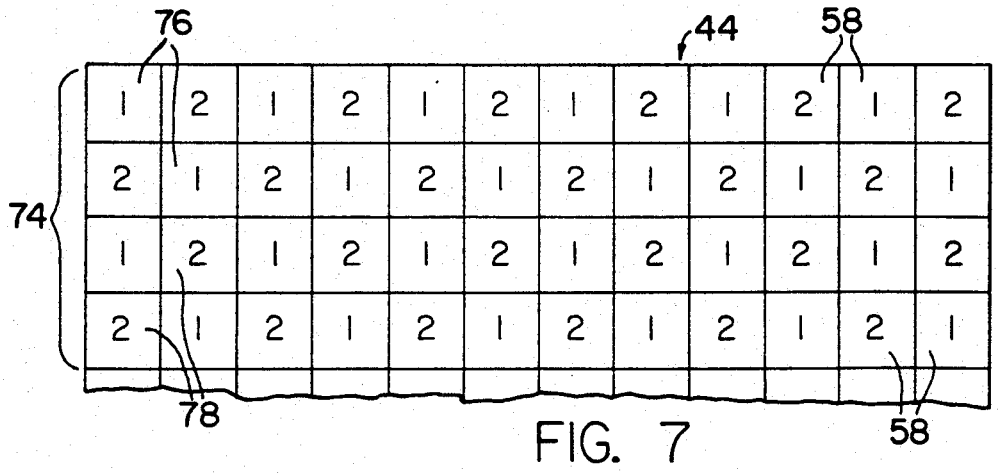

As a third alternative, the pixel locations 58, 58 are printed as required to form an image on any given strip of the screen as a checkerboard pattern in two successive passes of the printhead across the strip. This is illustrated in FIG. 7 wherein during a first pass of the printhead across a strip 74 of the screen 44 only those diagonally disposed pixel locations, such as locations 76, 76 are printed. That is, during the first pass of the printhead across the strip pixel locations which are horizontally and vertically adjacent are not printed. During the second pass of the printhead across the strip, the remaining pixel locations are printed as required to form a desired image on the strip. Here again, of the remaining pixel locations only those, such as 78, 78 which are not horizontally and vertically adjacent are printed. The pixel locations printed during the first and second passes of the printhead across the strip 74 are designated 1, 1 and 2, 2 respectively. After the second pass of the printhead is complete, the screen and the printhead are moved relative to one another so that the above-described printing procedure can be performed on the next succeeding strip of the screen. The printhead is directed to make continuous passes across succeeding strips of the screen until the entire graphic is completed.

Figure 1A:
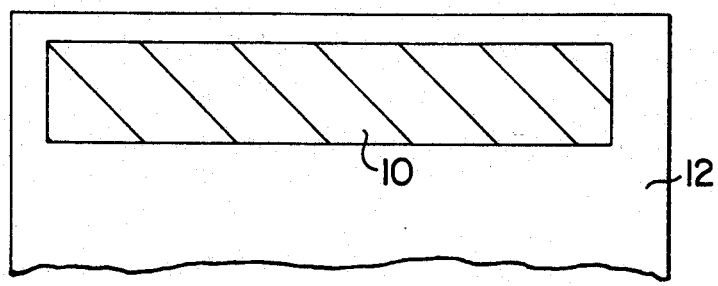
FIG. 1(a) PRIOR ART
FIG. 1(*a*) is a schematic illustration of a strip of emulsion printed in solid ink.
Figure 1:
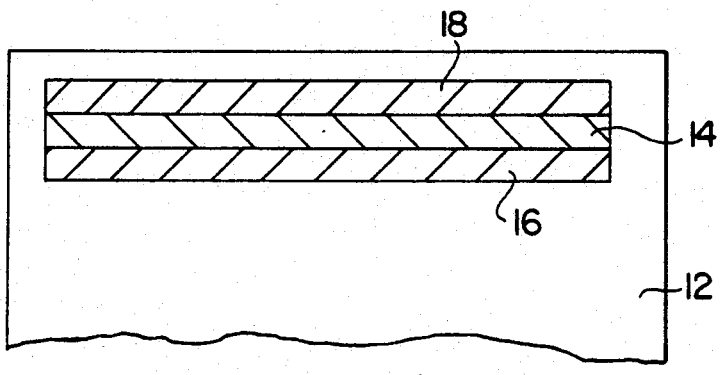
FIG. 1 (b) PRIOR ART
Figure 2:
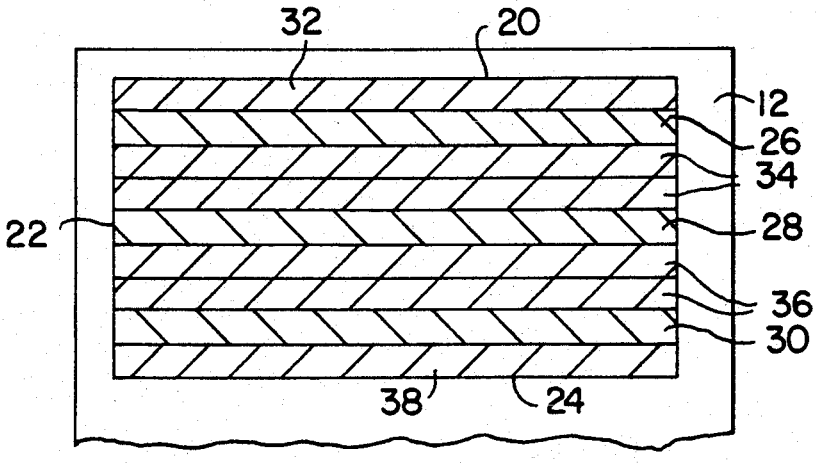
FIG. 2 PRIOR ART
FIG. 2 is a schematic illustration of a plurality of strips printed in succession showing the formation of scan lines.
Figure 8:
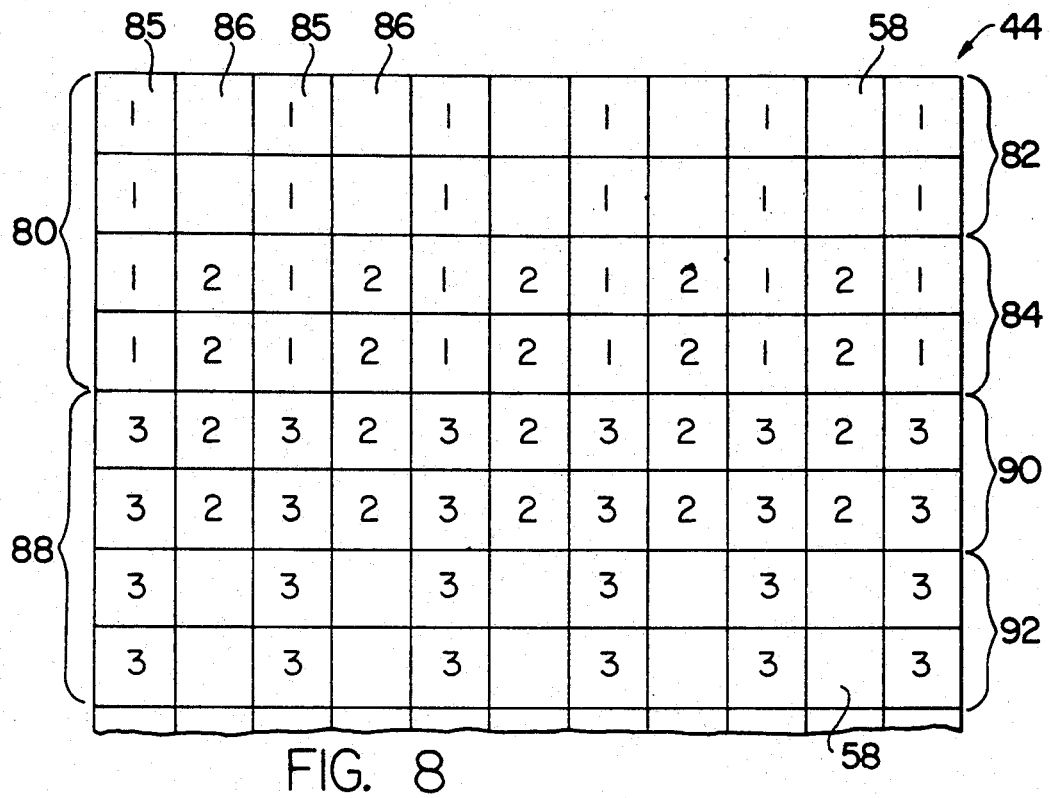
FIGS. 4–8 illustrate printing methods according to the present invention.

It has also been found that a combination of the above-described embodiments of the present printing method can be employed to provide a sharp, clear graphic having uniform ink density on an emulsion-coated screen. For example, FIG. 8 illustrates a strip 80 of the emulsion-coated screen having an upper portion 82 and a lower portion 84. The pixel locations 58, 58 in the strip are arranged in odd 85, 85 and even 86, 86 numbered columns. During the first pass of the printhead across the strip 80 only those pixel locations in the odd numbered columns are printed as required to form a desired image on the strip. After the printhead completes its first pass across the strip 80, the screen 44 and the printhead are moved relative to one another so that the pixel locations in the even numbered columns in the lower portion 84 of strip 80 can be printed as required to form a desired image on the strip.

The next succeeding strip 88 of the screen 44 also has an upper portion 90 and a lower portion 92, and the pixel locations in this strip are also arranged into odd 85 and even 86 columns. In addition to printing the required pixel locations in the even numbered columns in the lower portion of strip 80 during the second pass of the printhead across the screen, the pixel locations in the even numbered columns in the upper portion 90 of the strip 88 are also printed as required to form a desired image. The pixel locations on the screen printed during the first and second passes of the printhead are designated 1, 1 and 2, 2 respectively.

After the second pass of the printhead is complete, the screen and the printhead are moved relative to one another so that the pixel locations in the odd numbered columns in the upper portion 90 of strip 88 can be printed as required to form a desired image during the third pass of the printhead across the screen 44. As the printhead makes its third pass across the screen, the pixel locations in the odd numbered columns in the lower portion 92 of strip 88 are also printed as required to form a desired image. The pixel locations printed during the third pass of the printhead across the screen are designated 3, 3. The printhead is directed to make continuous passes across succeeding strips of the emulsion, in the manner described above with regard to the first, second and third passes, until the entire graphic is printed.

While preferred embodiments have been shown and described, various modifications and substitutions may be made without departing from the spirit and scope of the invention. For example, the printhead can be controlled so that printing occurs not only in the direction indicated by arrow A in FIG. 3, but also as the printhead moves back across the screen 44 in the reverse direction. Accordingly, it is to be understood that the present invention has been described by way of example and not by limitation.

We claim:

1. A method for printing a graphic having uniform ink density on selected pixel locations of a screen having a light sensitive emulsion applied to one surface thereof, said method comprising the steps of:

(a) mounting a printing screen having a light-sensitive emulsion applied to one surface thereof in a printing device, the device including a printhead having a plurality of ink-ejecting elements, wherein the screen is mounted in the device with the emulsion facingly opposed to the ink-ejecting elements to effectuate printing on the emulsion;

(b) making a first pass of the printhead across a first strip of the screen, said strip having a first upper and first lower portion, wherein the pixel locations in the first lower portion of the strip are printed as required to produce a desired image;

(c) making a second pass of the printhead across a second strip of the screen, the second strip having a second upper portion overlapping the first lower portion of the first strip and further including a second lower portion, wherein the pixel locations in the first lower portion of the first strip printed in the first pass are re-printed and the pixel locations in the second lower portion of the second strip are printed as required to produce a desired image;

(d) making a third pass of the printhead across a third strip of the screen, the third strip having a third upper portion overlapping the second lower portion of the second strip and further including a third lower portion, wherein the pixel locations in the second lower portion of the second strip printed in the second pass are re-printed and the pixel locations in the third lower portion of the third strip are printed as required to produce a desired image, and (e) making continuous passes of the printhead across a plurality of succeeding strips of the screen according to steps (b), (c) and (d) until the graphic is printed.

2. The method of claim 1 further including the step of providing the emulsion with an ink-receptive material prior to step (b).

* * * * *